US008851597B2

(12) United States Patent
Forrest

(10) Patent No.: US 8,851,597 B2
(45) Date of Patent: Oct. 7, 2014

(54) GAS CUSHION CONTROL OF OVJP PRINT HEAD POSITION

(75) Inventor: Stephen R. Forrest, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 13/807,878

(22) PCT Filed: Jul. 1, 2011

(86) PCT No.: PCT/US2011/042790

§ 371 (c)(1),
(2), (4) Date: Mar. 11, 2013

(87) PCT Pub. No.: WO2012/003440

PCT Pub. Date: Jan. 5, 2012

(65) Prior Publication Data

US 2013/0208036 A1 Aug. 15, 2013

Related U.S. Application Data

(60) Provisional application No. 61/400,506, filed on Jul. 29, 2010, provisional application No. 61/398,845, filed on Jul. 1, 2010.

(51) Int. Cl.
*B41J 25/308* (2006.01)
*B41J 11/00* (2006.01)

(52) U.S. Cl.
CPC ..... *B41J 11/008* (2013.01); *B41J 25/308* (2013.01); *B41J 25/3082* (2013.01)
USPC ..... 347/8; 347/37

(58) Field of Classification Search
CPC ..... B41J 11/008; B41J 25/082; B41J 25/304; B41J 25/308; B41J 19/00
USPC ..... 347/8
See application file for complete search history.

(56) References Cited

U.S. PATENT DOCUMENTS

| | | | | |
|---|---|---|---|---|
| 5,065,169 | A * | 11/1991 | Vincent et al. | 347/8 |
| 5,363,761 | A | 11/1994 | Galassi | |
| 6,119,536 | A * | 9/2000 | Popovic et al. | 73/866.5 |
| 6,629,787 | B2 | 10/2003 | Lee et al. | |
| 2005/0062824 | A1 | 3/2005 | Jensen | |
| 2007/0048057 | A1 | 3/2007 | Youn et al. | |

OTHER PUBLICATIONS

International Search Report for PCT/US2011/042790 dated Feb. 9, 2012, 3 pages.
Written Opinion for PCT/US2011/042790 dated Feb. 9, 2012, 4 pages.

* cited by examiner

*Primary Examiner* — Juanita D Jackson
(74) *Attorney, Agent, or Firm* — Reising Ethington P.C.

(57) ABSTRACT

An OVJP apparatus and method for applying organic vapor or other flowable material to a substrate using a printing head mechanism in which the print head spacing from the substrate is controllable using a cushion of air or other gas applied between the print head and substrate. The print head is mounted for translational movement towards and away from the substrate and is biased toward the substrate by springs or other means. A gas cushion feed assembly supplies a gas under pressure between the print head and substrate which opposes the biasing of the print head toward the substrate so as to form a space between the print head and substrate. By controlling the pressure of gas supplied, the print head separation from the substrate can be precisely controlled.

18 Claims, 1 Drawing Sheet

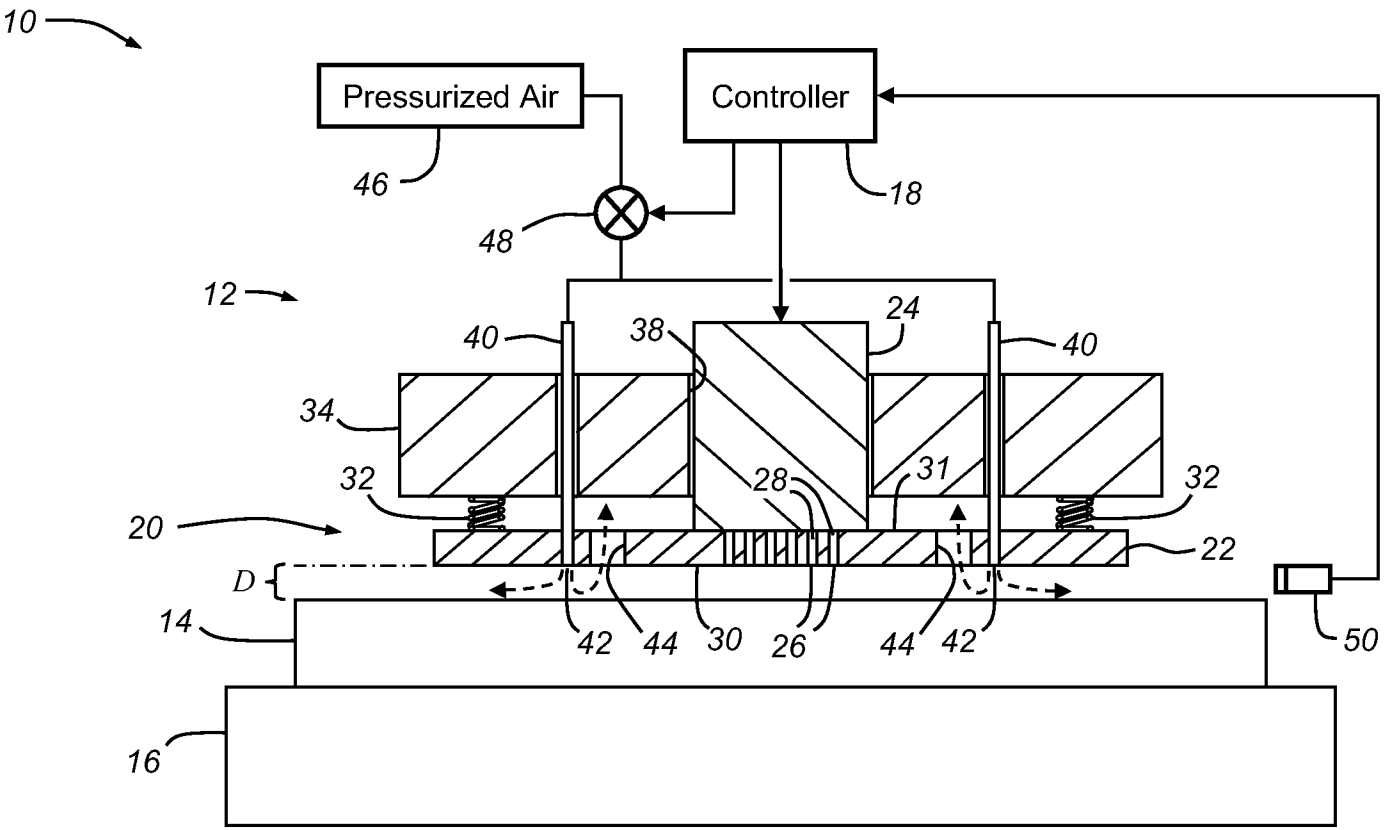
Controller
Pressurized Air
10
12
14
16
18
20
22
24
26
28
30
31
32
34
38
40
42
44
46
48
50
D

GAS CUSHION CONTROL OF OVJP PRINT HEAD POSITION

CROSS-REFERENCE TO RELATED APPLICATION

This application claims the benefit of U.S. Provisional Application Nos. 61/398,845, filed Jul. 1, 2010, and 61/400,506, filed Jul. 29, 2010.

STATEMENT OF FEDERALLY-SPONSORED RESEARCH

This invention was made with government support under Contract No. DE-SC0002122 awarded by The Department of Energy. The government has certain rights in the invention.

JOINT RESEARCH AGREEMENT

The claimed invention was made by, on behalf of, and/or in connection with one or more of the following parties to a joint university corporation research agreement: Regents of the University of Michigan, Princeton University, The University of Southern California, and the Universal Display Corporation. The agreement was in effect on and before the date the claimed invention was made, and the claimed invention was made as a result of activities undertaken within the scope of the agreement.

TECHNICAL FIELD

The invention relates generally to organic vapor jet printing (OVJP) and, more particularly, to methods and apparatus for controlling the spacing of an OVJP print head relative to a substrate onto which the organic material is to be applied.

BACKGROUND OF THE INVENTION

Organic vapor jet printing is a known technique for the deposition of organic materials onto a substrate. It can be used to produce organic light emitting diodes (OLEDs) and other eletro-phosphorescent devices, as well as photo-responsive devices such as organic phototransistors, organic photovoltaic cells, and organic photodetectors. Pixel dimensions on the order of microns are achievable using known techniques—see, for example, U.S. Patent Application Publication Nos. 2010/0245479A1 and 2010/0247766A1, both published Sep. 30, 2010. The complete contents of these published applications are hereby incorporated by reference. To achieve such pixel densities, accurate positioning of the print head within a few microns of the substrate is desirable.

SUMMARY OF THE INVENTION

According to one aspect of the invention, there is provided a method of controlling a separation distance between a print head and a substrate. The method includes the steps of: (a) biasing a print head toward a substrate onto which flowable material from the print head is applied under pressure; and (b) controlling a separation distance between the print head and substrate by forming a gas cushion between the print head and substrate that opposes the biasing applied in step (a).

According to another aspect of the invention, there is provided a printing head mechanism for use in applying organic vapor or other flowable material to a substrate. The printing head mechanism includes a print head and gas cushion feed assembly. The print head is mounted for translational movement relative to a substrate on which flowable material from the print head is to be applied. The print head is biased toward the substrate in the absence of an applied external force. The gas cushion feed assembly supplies a gas under pressure between the print head and substrate which opposes biasing of the print head toward the substrate so as to form a space between the print head and substrate.

According to yet another aspect of the invention, there is provided a printing head mechanism for use in applying flowable material to a substrate. The printing head mechanism includes a print head, fixture, one or more biasing members, and a gas cushion feed assembly. The print head has a nozzle plate and a nozzle feeder connected to the nozzle plate for supplying flowable material under pressure to the nozzle plate. The nozzle plate includes at least one array of nozzles and passages that provide fluidic communication between the nozzle feeder and nozzles. The nozzles comprise apertures located in a surface of the nozzle plate. When in use, the surface of the nozzle plate is positioned opposite the substrate with the surface being spaced from the substrate by a separation distance across which the flowable material moves under pressure as it is applied by the print head from the nozzles onto the substrate. The fixture supports the nozzle plate in a manner that permits relative motion between the fixture and nozzle plate such that the separation distance is adjustable. The one or more biasing members are coupled to the print head and fixture, and operate to bias the nozzle plate toward the substrate when in use. The gas cushion feed assembly comprises at least one gas cushion feed line and one or more outlets located at the nozzle plate such that gas supplied through the one or more outlets provides a gas cushion between the nozzle plate and substrate that opposes the biasing of the biasing member(s) to thereby permit control of the separation distance based on the pressure of the gas supplied via the gas feed lines.

Also provided is an OVJP apparatus and method using any of the printing head mechanisms and methods identified herein.

BRIEF DESCRIPTION OF THE DRAWING

Preferred exemplary embodiments of the invention will hereinafter be described in conjunction with the appended FIGURE which depicts a diagrammatic view of a printing head mechanism constructed according to one embodiment of the invention.

DETAILED DESCRIPTION OF THE ILLUSTRATED EMBODIMENT

Described below are embodiments of a method and apparatus useful in OVJP to provide a controllable spacing of an OVJP print head relative to a substrate upon which organic material from the print head is applied. In general, the print head is biased toward the substrate with an air or other gas cushion being applied between the print head and substrate to counteract the bias in a manner that allows for controllable separation spacing of the print head from the substrate to within a few microns.

An exemplary apparatus used to achieve this tight spacing is depicted in the FIGURE which shows an OVJP apparatus 10 that generally includes a printing head mechanism 12 positioned opposite a substrate 14 supported by a substrate holder 16, and a controller 18 that provides the various control signals used to operate the printing apparatus. As will be appreciated by those skilled in the art, printing apparatus 10 includes additional components known in the art, such as one or more sources of organic material, one or more heating sources for vaporizing the organic material, a source of carrier gas to mix with and transport the organic vapor to a heating chamber where the mixture can be further heated to proper temperatures in preparation for deposition, and transport lines to provide the heated organic vapor under pressure to the printing head mechanism 12. At least some of these additional components can be incorporated into the printing head mechanism 12. Other additional components of printing apparatus 10 that are not shown may include a transport drive operated by controller 18 or otherwise for one or two dimensional translation of substrate holder 16, or a transport mechanism for printing mechanism 12, either of which can be used to provide relative parallel translational motion between the printing head mechanism 12 and substrate 14. All of the aforementioned additional components of printing apparatus 10 not shown in the FIGURE can be implemented in a manner known in the art and no further discussion is needed or provided herein. Some of these components can also be implemented as shown and described in U.S. Patent Application Publication No. 2009/0214783A1, published Aug. 27, 2009, the complete contents of which are hereby incorporated by reference.

Printing head mechanism 12 includes a print head 20 having a nozzle plate 22 and nozzle feeder 24 connected to the nozzle plate 22 for supplying organic vapor or other flowable material under pressure to the nozzle plate 22. These components can be generally constructed as is known in the art; for example, as disclosed in the aforementioned U.S. Patent Application Publication Nos. 2010/0245479A1 and 2010/0247766A1. The nozzle plate 22 includes at least one array of nozzles 26 and passages 28 that provide fluidic communication between the nozzle feeder 24 and the nozzles 26. As is known, the nozzles 26 each comprise at least one aperture located in a flat front surface 30 of nozzle plate 22, and the nozzle geometry can be any design suitable for the intended use of printing apparatus 10. As shown, when printing apparatus 10 is in use the surface 30 is positioned opposite the substrate 14 with the surface 30 being spaced from the substrate by a separation distance D across which the vaporized organic material moves under pressure as it is applied by the print head 20 from the nozzles 26 onto the substrate 14.

As shown in the FIGURE, printing head mechanism 12 further includes a set of compression springs 32, a fixture 34, and a gas cushion feed assembly 36. Compression springs 32 act as biasing members that are directly connected to or otherwise coupled between the print head 20 and the fixture 34 so as to provide a biasing force that urges the nozzle plate 22 towards the substrate 14. This is accomplished in part by using fixture 34 to support the nozzle plate 22 while permitting relative motion between the nozzle plate and fixture such that the separation distance D is adjustable. For this purpose, fixture 34 may comprise a collar having an internal bore 38 with a cross-sectional shape that is the same as, but slightly larger than that of nozzle feeder 24 so that the nozzle feeder and its attached nozzle plate 22 can move linearly relative to the fixture in a direction perpendicular to surface 30 (i.e., towards and away from substrate 14 and substrate holder 16).

To counteract the bias provided by springs 32, a gas cushion is formed between the nozzle plate 22 and substrate 14 that urges the nozzle plate away from the substrate by an amount dependent on the pressure level of the gas. To accomplish this, gas cushion feed assembly 36 is provided and includes a set of gas cushion feed lines 40 and outlets 42. In the embodiment shown, feed lines 40 extend through and can move relative to fixture 34 along with print head 20. The feed lines 40 terminate at nozzle plate 22 where they are in fluidic communication with the outlets 42 either via passageways in the nozzle plate or by extending through the nozzle plate to the outlets. The one or more arrays of nozzles 26 are located at a central region of the nozzle plate 22 with the outlets 42 being positioned at a plurality of locations about the periphery of the group of nozzles 26, and this arrangement tends to balance the gas cushion pressure across the nozzle plate 22 so as to maintain an even separation distance D at all locations.

The outlets 42 can be spaced from the outermost nozzles 26 so as to help prevent the gas exiting the outlets from interfering with the deposition of organic material onto the substrate. Moreover, vents 44 can be provided through the nozzle plate 22 at locations between the outlets 42 and the nozzles 26. The vents 44 may be sized to permit gas from the gas cushion to vent from between the nozzle plate 22 and the substrate 14 without substantially interfering with the application of the organic material onto the substrate. Thus, as shown in the FIGURE, gas from the gas cushion can escape from around the outlets 42 in part by exiting laterally out of the space between the print head and substrate, as shown by the substantially horizontal dashed arrows, and in part by exiting upwardly through the vents 44 as shown by the substantially vertical dashed arrows, and this helps prevent the gas cushion from distorting or otherwise affecting the gas jet flow of organic material during the printing process.

In some embodiments, the gas cushion feed lines can be routed through the nozzle feeder 24 and through the nozzle plate to outlets located about the nozzles 26 at a location below the nozzle feeder 24, or can be routed through the nozzle feeder 24 and then laterally outwardly through channels running through nozzle plate 22 parallel to surface 30 or via separate feed lines. Other such variations will become apparent to those skilled in the art.

The actual spacing D of the print head 20 from the substrate 14 will be determined by the sum of all forces tending to urge the nozzle plate toward the substrate 14 (e.g., the spring force, gravity, etc.) and by the opposing force exerted by the pressure of the gas cushion formed between the nozzle plate and substrate. This gas cushion pressure can be controlled by controlling the pressure of the gas supplied via the feed lines 40. Thus, the separation distance D itself can be controlled by controlling the pressure of the gas supplied via the feed lines 40.

To supply the pressurized gas used in forming the gas cushion, printing apparatus 10 includes a source 46 of pressurized gas such as compressed air, a control valve 48 connected between the gas pressure source 46 and the feed lines 40, and the controller 18 (or a separate control circuit) connected to the valve 48 to control the supply of gas into the feed lines based on an input control signal sent from the controller to the control valve. Control valve 48 can be operated using whatever control signal is appropriate for the valve; for example, one having an amplitude that is adjustable in accordance with the degree of valve opening desired, or by modulating the valve between open and closed positions. Also, printing apparatus 12 can have a separate valve in each feed line with separate control signal inputs to each that permit adjustment of each valve independently of the other. This can be used to control the parallelism of the surface 30 relative to the substrate 14. The pressurized gas used can be heated to temperatures consistent with the OVJP process to help minimize thermal gradients and shock. Any suitable gas can be used such as air, nitrogen, inert or active gases, and the particular gas selected can be used in some embodiments to provide shielding of the organics being deposited from undesirable external gases or elements such as reactive elements (e.g., oxygen) or contaminants that might reduce the performance of the device being manufactured. In other embodiments, a gas that provides a desirable reaction or desirably affects the deposition of the organic material onto the substrate can be used.

Controller 18 operates to supply a control signal to control valve 48 to set the pressure of gas supplied to the feed lines 40 to a level selected so as to obtain the desired separation spacing D. The control signal can be generated based on various parameters and inputs, including feedback of relative print head positioning such as through a position detector 50 which can be an optical, electrostatic, or other detector capable of providing accurate feedback of nozzle plate position relative to the substrate 14. The use of a position sensor permits closed loop control of the separation spacing D by using the fed back position information to adjust the gas pressure into feed lines 40 until the desired spacing D is obtained.

Apart from the particular embodiment diagrammatically illustrated in the FIGURE, various other embodiments and implementations of the various components and assemblies shown in the FIGURE can be used. For example, one or more biasing members other than the spaced compression springs 32 can be used—e.g., one single compression spring located about nozzle feeder 24, or a different type of spring or other component(s) that provide a biasing force that urges the nozzle plate away from the substrate 14 and its holder 16. Examples of non-spring biasing members that may be used include those that utilize pneumatic pressure, magnetic attraction or repulsion, material resiliency, weight (gravity) or any other biasing approach suitable for the particular application of printing mechanism 12. Fixture 34 in the illustrated embodiment has a fixed spacing relative to the substrate 14 when in use, but embodiments in which the fixture spacing is adjustable may also be used. As shown in the FIGURE, nozzle feeder 24 extends longitudinally in a direction substantially perpendicular to the surface 30 and is attached to the print head at a rear surface 31 of the nozzle plate 22. However, structural designs of print head 20 other than that shown can be used that permit the separation distance D to be adjusted to within a few microns. Also, other approaches for producing a gas cushion that enables the print head to float over the substrate can be used. And although a control valve 48 is used in the illustrated embodiment to achieve control of the gas pressure delivered to the feed lines 40, other equipment and techniques for controlling that pressure can be used. All such other variations can be implemented by those skilled in the art.

Printing apparatus 10 can be used to carry out a method of OVJP printing which generally includes the steps of (a) biasing a print head toward a substrate onto which organics or other flowable material from the print head is applied under pressure; and (b) controlling the separation distance between the print head and substrate by forming a gas cushion between the print head and substrate that opposes the biasing applied in step (a). These steps can be carried out using the print head 12 while it is supported in the fixture 34. The biasing in step (a) can comprise biasing the print head 12 away from the fixture using a biasing member such as the compression springs 32 that are coupled to both the fixture and the print head. As noted above, the method can include the step of translating the nozzle plate 22 in a direction toward or away from the substrate 14 using the gas cushion. This translation can be done by adjusting the gas pressure supplied to the feed lines 40 to thereby control the separation distance D. While the print head spacing D is being maintained at its desired value during use, the OVJP process can be carried out by applying the organic material to the substrate 14 through the print head 12 while simultaneously carrying out steps (a) and (b).

It is to be understood that the foregoing description is of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method of controlling a separation distance between a print head and a substrate, comprising the steps of:

(a) biasing a print head toward a substrate onto which flowable material from the print head is applied under pressure; and (b) controlling a separation distance between the print head and substrate by forming a gas cushion between the print head and substrate that opposes the biasing applied in step (a), wherein the print head includes a nozzle plate having at least one array of nozzles and wherein the method further comprises the step of translating the nozzle plate in a direction toward or away from the substrate using the gas cushion.

2. The method of claim 1, further comprising the step of providing the print head in a fixture that is spaced from the substrate by a substantially fixed distance, wherein step (a) further comprises biasing the print head away from the fixture using at least one biasing member coupled to both the fixture and the print head.

3. The method of claim 1, further comprising the step of applying the gas cushion via outlets in the nozzle plate that are located around the perimeter of the at least one array of nozzles.

4. The method of claim 3, further comprising the step of venting the gas cushion using a plurality of vents positioned between the outlets and nozzles such that gas from the gas cushion vents from between the nozzle plate and the substrate without substantially interfering with the application of the flowable material onto the substrate.

5. The method of claim 1, wherein the flowable material comprises an organic material and wherein the method further comprises the step of carrying out organic vapor jet printing by applying the organic material to the substrate through the print head while simultaneously carrying out steps (a) and (b).

6. A printing head mechanism for use in applying flowable material to a substrate, comprising:

a print head mounted for translational movement relative to the substrate on which flowable material from the print head is to be applied, said print head being biased toward the substrate in the absence of an applied external force; and a gas cushion feed assembly that supplies a gas under pressure between said print head and the substrate which opposes biasing of said print head toward the substrate so as to form a space between said print head and the substrate, wherein said print head includes a nozzle plate having a surface at which one or more nozzles is located and which confronts the substrate when in use, and wherein the print head includes a nozzle feeder connected to said nozzle plate for supplying the flowable material under pressure to said nozzle plate, said nozzle plate including passages that provide fluidic communication between said nozzle feeder and said one or more nozzles, said one or more nozzles comprising apertures located in the surface of said nozzle plate, wherein when in use, said surface of said nozzle plate is positioned opposite the substrate with said surface being spaced from the substrate by a separation distance across which the flowable material moves under pressure as it is applied by said print head from said one or more nozzles onto the substrate.

7. A printing head mechanism as defined in claim 6, further comprising a fixture supporting said print head, said print head being biased toward the substrate via at least one biasing member disposed between said print head and said fixture.

8. A printing apparatus including a printing head mechanism as defined in claim 6, wherein said print head includes a plurality of nozzles and a plurality of outlets disposed about said nozzles, and further comprising a gas pressure source, a control valve connected between said gas pressure source and said outlets to control the supply of gas to said outlets based on an input control signal to said control valve, and a controller that generates and supplies the control signal to said control valve.

9. A printing apparatus as defined in claim 8, wherein said print head includes at least one vent positioned between said one or more outlets and said nozzles, said one or more vents being sized to permit gas from the gas cushion to vent from between said print head and the substrate without substantially interfering with the application of the flowable material onto the substrate.

10. A printing head mechanism for use in applying flowable material to a substrate, comprising:

a print head having a nozzle plate and a nozzle feeder connected to said nozzle plate for supplying flowable material under pressure to said nozzle plate, said nozzle plate including at least one array of nozzles and passages that provide fluidic communication between said nozzle feeder and said nozzles, said nozzles comprising apertures located in a surface of said nozzle plate, wherein when in use, said surface of said nozzle plate is positioned opposite the substrate with said surface being spaced from the substrate by a separation distance across which the flowable material moves under pressure as it is applied by said print head from said nozzles onto the substrate;

a fixture supporting said nozzle plate and permitting relative motion between said fixture and said nozzle plate such that said separation distance is adjustable;

one or more biasing members coupled to said print head and said fixture, said one or more biasing members biasing said nozzle plate toward the substrate when in use; and a gas cushion feed assembly comprising at least one gas cushion feed line and one or more outlets located at said nozzle plate such that gas supplied through said one or more outlets provides a gas cushion between said nozzle plate and the substrate that opposes the biasing of said one or more biasing members to thereby permit control of the separation distance based on the pressure of the gas supplied via said gas feed lines.

11. A printing head mechanism as defined in claim 10, wherein said one or more biasing members comprise a plurality of springs positioned between said fixture and said nozzle plate.

12. A printing head mechanism as defined in claim 10, wherein said nozzle plate includes a central region at which said nozzles are located and wherein said one or more outlets comprise a plurality of outlets connected to said feed lines and being located in said nozzle plate in an area surrounding and spaced from said nozzles.

13. A printing head mechanism as defined in claim 10, wherein said nozzle plate includes at least one vent positioned between said one or more outlets and said apertures of said nozzles, said one or more vents being sized to permit gas from the gas cushion to vent from between said nozzle plate and the substrate without substantially interfering with the application of the flowable material onto the substrate.

14. A printing head mechanism as defined in claim 10, wherein said fixture has a fixed spacing relative to the substrate when in use.

15. A printing head mechanism as defined in claim 10, wherein said nozzle feeder extends longitudinally in a direction substantially perpendicular to said surface and is attached to said print head at a rear surface of said nozzle plate.

16. A printing head mechanism as defined in claim 10, wherein said fixture comprises a collar surrounding said nozzle feeder.

17. A printing apparatus comprising a printing head mechanism as defined in claim 10 and further including:

a gas pressure source;

a control valve connected between said gas pressure source and said at least one feed line to control the supply of gas into at least one said feed line based on an input control signal to said control valve; and a controller that generates and supplies the control signal to said control valve.

18. An organic vapor jet printing apparatus comprising the printing head mechanism of claim 10.

* * * * *